3/22/88 XR 4,732,527

United States Patent [19]

Conche

[11] Patent Number: 4,732,527

[45] Date of Patent: Mar. 22, 1988

[54] PROCEDURE FOR TRANSFERRING OBJECTS WITHOUT BREAKING CONFINEMENT

[75] Inventor: François Conche, Les Mureaux, France

[73] Assignee: Cogema, France

[21] Appl. No.: 761,567

[22] Filed: Aug. 1, 1985

[51] Int. Cl.[4] ..... G21C 19/00

[52] U.S. Cl. ..... 414/786; 414/146; 414/217

[58] Field of Search ..... 414/786, 8, 146, 221, 414/217, 288, 304; 376/260, 272, 340, 341

[56] References Cited

U.S. PATENT DOCUMENTS

| | | | |
|---|---|---|---|
| 4,281,691 | 8/1981 | Goutard et al. | 414/146 X |
| 4,412,771 | 11/1983 | Gerlach et al. | 414/217 |
| 4,466,791 | 8/1984 | Jacobs et al. | 414/221 X |
| 4,532,816 | 8/1985 | Miller | 414/217 X |
| 4,532,970 | 8/1985 | Tullis et al. | 414/217 X |

FOREIGN PATENT DOCUMENTS

| | | |
|---|---|---|
| 1449887 | 4/1902 | France . |
| 1226659 | 4/1902 | France . |
| 2161805 | 7/1973 | France . |
| 2462769 | 2/1981 | France . |

*Primary Examiner*—Joseph E. Valenza
*Assistant Examiner*—David A. Bucci
*Attorney, Agent, or Firm*—Lucas & Just

[57] ABSTRACT

A procedure for transferring an object along an axis, from a contaminated and radioactive zone to a clean zone without breaking the confinement when the zones are separated by a slab is disclosed. The slab contains a plug and the object can be secured to the plug with the use of a stationary pre-enclosure (43) equipped with two plugs (44 and 46) and of a movable transfer enclosure (47) equipped with one plug (48). The enclosure and pre-enclosure are placed in alignment with the transfer axis.

8 Claims, 12 Drawing Figures

PROCEDURE FOR TRANSFERRING OBJECTS WITHOUT BREAKING CONFINEMENT

In a nuclear plant, areas containing hazardous materials are separated by thick walls and slabs from areas where personnel may be present.

The hazardous area is generally termed the active region of the plant. The radioactive products which may be present in this zone include gamma-emitters, which justify the thick containment walls, and/or alpha and beta emitters, considered to be contaminants. All equipment leaving an active region is considered contaminated and must be placed behind a thick wall (to protect against gamma rays) and within a sealed enclosure (to avoid spreading the contamination).

When equipment in the active region must be replaced or taken out and transferred to a maintenance cell, or conversely, when it is desired to return same to its working location, full confinement must be maintained throughout the transfer procedure to avoid spreading the contamination. It is also crucial to maintain a sufficient wall thickness as a biological shield between said equipment and the plant personnel as the equipment is transferred to the maintenance or repair cell.

This invention concerns such a procedure for transferring an "object" such as a piece of equipment, a machine component, a waste drum and the like from the active region or containment to the clean region, for transporting or conveying said object within the clean region and transferring it back from the clean region to the active region without ever departing from containment and biological safety requirements.

A first feature of the invention consists in using, for the purpose of maintaining confinement, a two-part device including a stationary pre-enclosure and a movable "transfer" enclosure.

The pre-enclosure is kept in place throughout the time required to extract an object, remove it to a cell and either bring back another object or return the same object after repair to the active region or containment.

The invention will be described in terms of an active cell accessible through its top, with transfer operations carried out vertically (over-the-wall handling).

However, the same procedure applies to all geometrical arrangements such as through-the-wall transfer or through-the-floor.

This description will thus concern an active cell the ceiling whereof is a horizontal slab with a plug therein.

The top surface of the plug is clean and must be kept clean. The inside face of the plug is within the active region and is considered contaminated and contaminating.

The object, at least at the time of transfer, is suspended from the plug. The object's dimensions are assumed to be such that, on lifting the plug, said object can be removed through the unplugged opening.

The invention will be more readily understood by referring throughout the following description to the appended drawings in which.

Figure 8:
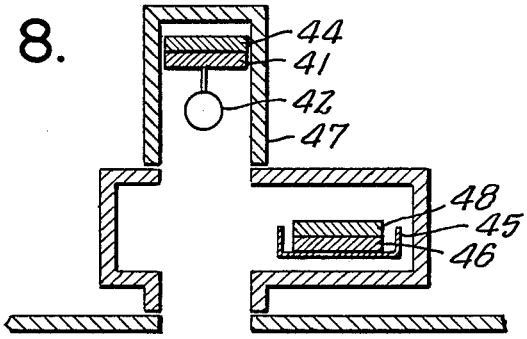
Figure 9:
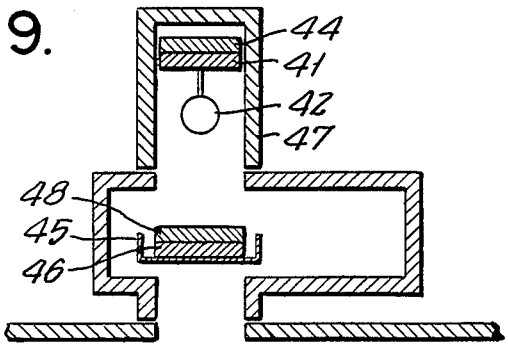
Figure 10:
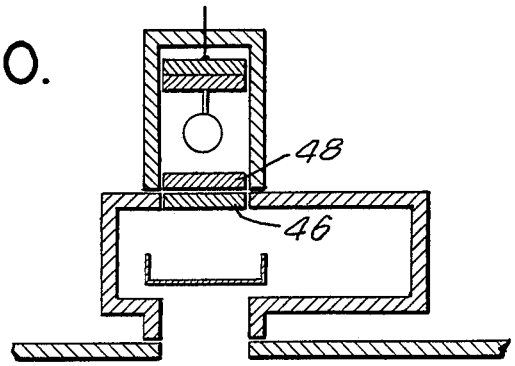

FIGS. 4, 5, 6 and 7 schematically show the position of the various plugs when an object is being extracted from the active cell;

FIG. 8 shows the object removed from the cell and placed in the movable enclosure;

FIGS. 9 and 10 illustrate the replugging of the cell; and

Figure 11:
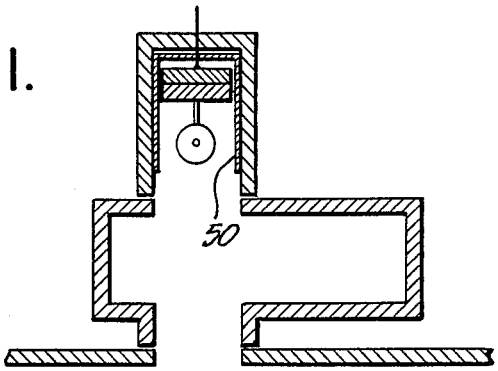
Figure 12:
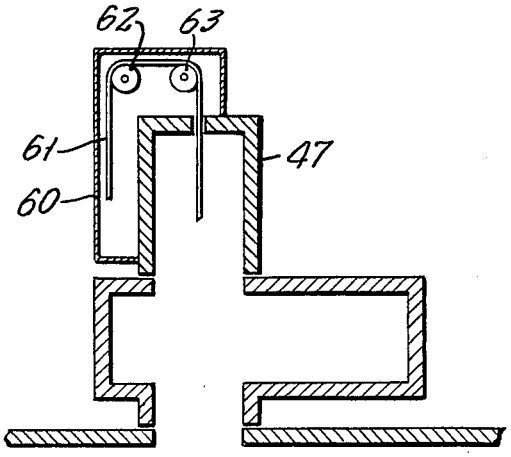

FIGS. 11 and 12 respectively show an alternative embodiment with a bell-shaped protective cap in the movable enclosure and a push-chain handling means.

Figure 1:
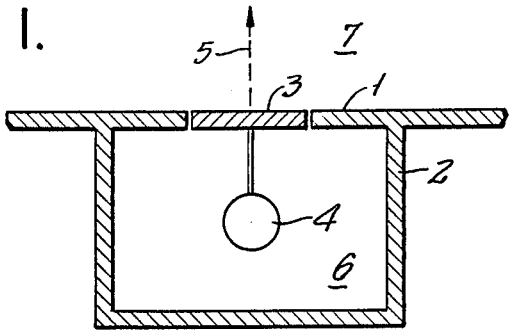
FIG. 1 shows a schematic cross section of an active cell.

FIG. 1 gives a sectional view of an active cell comprising a horizontal slab 1 and walls 2. The plug 3 separates the active region 6 from the clean region 7.

The object to be transferred 4 is suspended from the plug. The transfer will be carried out along axis 5, which is assumed to be vertical for greater clarity of the description.

Figure 2:
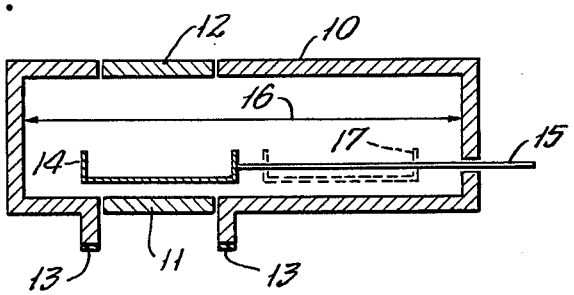
FIG. 2 is a section through the pre-enclosure.

FIG. 2 shows a pre-enclosure cut by a vertical plane on the transfer axis.

The walls 10 delimit a closed box containing two plugs, both located along the vertical transfer axis, namely: a lower plug 11 and and upper plug 12.

Within said pre-enclosure, a carriage 14 can be moved horizontally by means of a control rod 15. For greater clarity, the wheels of the carriage, as well as the rails on which they roll, have been omitted from the schematic drawing.

The longitudinal dimension 16 of the inside of the pre-enclosure is such that the passage along the transfer axis is clear when the carriage is located in position 17.

The carriage positions 14 and 17 will be respectively referred to as the left or left-hand and right or right-hand positions throughout the following description. Sealing means 13 steady the tightness between the active cell and the pre-enclosure.

Figure 3:
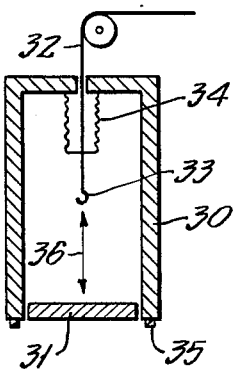
FIG. 3 is a section through the movable enclosure.

The movable enclosure is schematically illustrated in FIG. 3 and can be seen to consist of a cylindrical or prism-shaped box having a wall or walls 30 parallel to transfer axis 36.

The top of said enclosure is closed except for an opening for a cable 32 sealed with a bellows 34. The end of the cable is provided with a hook 33.

The bottom of said enclosure includes a removable plug 31 and sealing means 35 for tightness between the enclosure and the pre-enclosure.

Having thus described the physical features of the invention, the operating principle may now be explained, for example in terms of removing an object from the cell.

Figure 4:
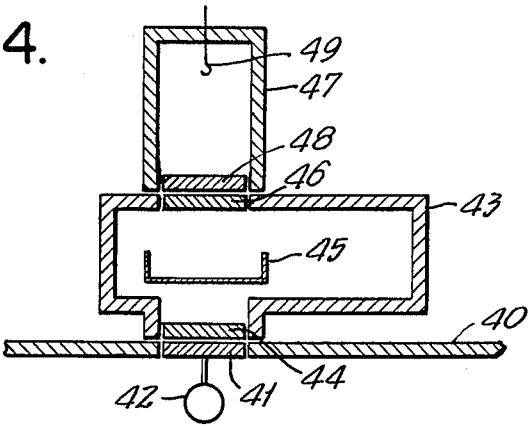

The mutual arrangement of the components described in the foregoing is illustrated in FIG. 4 and the transfer operation is described with reference to the following figures.

Items appearing in several figures will keep the same reference.

Basically then, the top slab 40 of the cell comprises the plug 41 and the "object" to be transferred 42 suspended therefrom.

Pre-enclosure 43 is placed on the slab in alignment with the vertical transfer axis.

Plug 44 and plug 46 are in place and the carriage 45 is located to the left.

The enclosure 47 is placed on the pre-enclosure in alignment with the transfer axis.

Plug 48 is in place. And the hook bears the reference 49.

Attention is drawn to the fact that neither the thickness of the enclosure and pre-enclosure walls, nor the sealing means between the different components are represented in the drawings, with intent.

Figure 5:
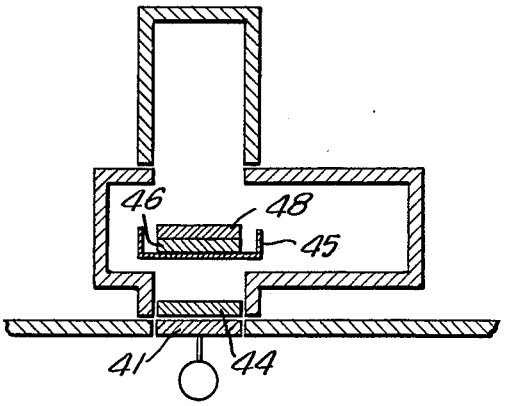

FIG. 5 shows the first step in the transfer, which consists in bringing together the plugs in pairs.

Bottom plug 44 of the pre-enclosure is made fast on the slab plug 41.

Plug 48 of the enclosure is made fast on the top plug 46 of the pre-enclosure and this assembled pair is placed in the carriage. A device not covered by the claims is used to lock and unlock the two plugs by means of an outside control rod (also omitted from the drawing).

The purpose of these couplings is to protect from contamination the faces of the plugs which will be exposed in the clean zone.

Figure 6:
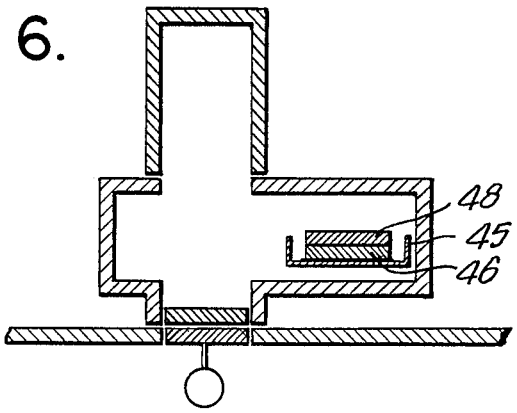

Thereafter, the carriage 45 is pulled to the right-hand position as shown in FIG. 6.

Figure 7:
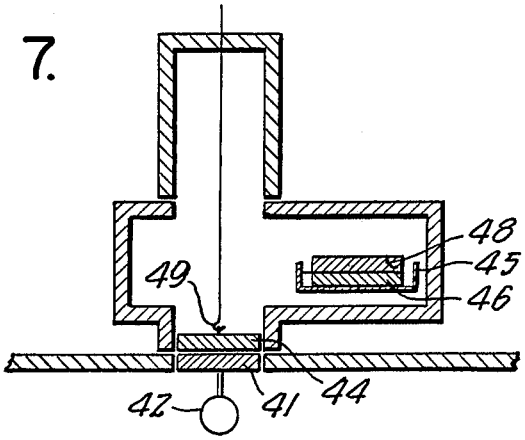

FIG. 7 shows the hook 49 hooked onto the assembly made up of plugs 41 and 44 and the object 42. The bellows seal around the cable has been omitted from the drawing.

Said assembly 41, 44, 42 is pulled up by the cable into the enclosure 47, as shown in FIG. 8, whereafter the carriage 45 is moved back to the left-hand position as in FIG. 9 and plug 46 is returned to block the opening at the top of the pre-enclosure as in FIG. 10.

It is then possible to pick up enclosure 47 and take it elsewhere.

Confinement has been maintained throughout and enclosure 47 is now closed by its plug 48 whose bottom face has never been contaminated since it has been kept in contact at all times with the equally clean top face of pre-enclosure plug 46.

The said pre-enclosure effects closure of the cell thanks to the tightness of the contacts (the seals 13 of FIG. 2) and top plug 46, now back in its initial position.

The devices used to couple the plugs in pairs and to lift the joined plugs are intentionally not represented and may be of any suitable known type.

The seals used between the cell and the pre-enclosure and between the pre-enclosure and the enclosure may advantageously be three-way acting seals.

In FIG. 11 can be seen another embodiment of the device utilized in carrying out the inventive procedure.

By way of a variant, it may be envisaged to equip the movable enclosure with a bell or lining cap 50 sliding snugly with seals, to avoid contaminating the inside of the enclosure.

Also, the lifting and lowering operations can be effected by means of a specialty chain with a pushing capability, such as the locking-link "rigid" chain made by SERAPID (France), housed in a tunnel attached to the enclosure. This arrangement is illustrated in FIG. 12.

As the figure shows, a tunnel 60 mounted on the enclosure 47 comprises a rigid chain 61 running over two deflecting sheaves 62, 63. To simplify, the opposite sheaves and the guides for the rigid chain links have been omitted from the drawing.

This device affords the advantage of operating with low head-room whilst concentrating the plug and object lifting means on the enclosure. It is particularly convenient for conveying the equipment 42 and unloading it in a maintenance cell for repair or overhaul.

The foregoing description outlined the procedure according to the invention for transferring an object which can be removed vertically and upwardly. It has been indicated that the procedure can be carried out vertically downward to feed an object into a cell and it should be apparent to those knowledgeable in the art that the same procedure can be applied with slight alteration to:

horizontal transfer with a plug located on a vertical wall, vertical transfer with a plug in the floor of the cell, and in general a transfer along any given axis.

The present invention has been described in relation to a nuclear facility. However, it is just as applicable to the transfer of objects contaminated by chemical or bacteriological pollutants.

What is claimed is:

1. Procedure for transferring an object along an axis from a contamination and radioactive zone A to a clean zone B where said object will be contained in a movable enclosure, said two zones A and B being separated by a slab containing a plug in line with the transfer axis, the object to be transferred being coupled to said slab plug and the uncontaminated zone B being kept clean throughout the transfer and transport operations in terms of both contamination and radiation, involving the following steps:

(a) set up a pre-enclosure having two plugs, on opposite sides thereof and both located on the transfer axis, on and surrounding the slab plug;

(b) set up a in a sealed manner on the pre-enclosure a movable enclosure also equipped with a plug such that said plug is in contact with the plug of the pre-enclosure opposite the slab plug;

(c) couple together the plugs which are in contact with one another, to form two fast pairs the first of which pairs consists of the slab plug and the pre-enclosure plug in immediate contact with it and the second of which pairs consists of the single plug of the enclosure and the pre-enclosure plug in immediate contact with it;

(d) remove said second pair of plugs sideways inside the pre-enclosure;

(e) secure said first pair of plugs and the object to be transferred to a hoist and transfer them all to the enclosure;

(f) refit said second pair of plugs along the transfer axis, in the respective plug holes of the enclosure and pre-enclosure, then uncouple the two plugs from one another and secure them individually in their holes;

(g) remove the enclosure containing said first pair of plugs and the object to another location.

2. Procedure according to claim 1, except carried out in reverse to transfer an object from zone B to zone A.

3. Procedure according to claim 1, whereby said plugs of said second pair are placed in or on a carriage after being coupled together and said carriage moves in a plane perpendicular to the transfer axis.

4. Procedure according to claim 3, involving the use of a bell or cup-like liner inside the movable enclosure, operable to slide over and enclose the assembly consisting of said first pair of plugs and said object to be transferred.

5. Procedure according to claim 3, whereby sealing is provided between said pre-enclosure and enclosure and between same said pre-enclosure and the confinement slab by three-way seals.

6. Procedure according to claim 5, involving the use of a rigid chain with a pushing capability to convey said first pair of plugs, together with the object to be transferred.

7. Procedure according to claim 2, whereby said plugs of said second pair are placed in or on a carriage after being coupled together and said carriage moves in a plane perpendicular to the transfer axis.

8. Procedure according to claim 4, whereby sealing is provided between said pre-enclosure and enclosure and between same said pre-enclosure and the confinement slab by three-way seals.

* * * * *